US007999638B2

(12) United States Patent
Niman et al.

(10) Patent No.: US 7,999,638 B2
(45) Date of Patent: Aug. 16, 2011

(54) MICROWAVE CIRCUIT ASSEMBLY COMPRISING A MICROWAVE COMPONENT SUSPENDED IN A GAS OR VACUUM REGION

(75) Inventors: Murray Jerel Niman, Chelmsford (GB); Robert Brian Greed, Chelmsford (GB)

(73) Assignee: BAE SYSTEMS plc, London (GB)

( * ) Notice: Subject to any disclaimer, the term of this patent is extended or adjusted under 35 U.S.C. 154(b) by 123 days.

(21) Appl. No.: 12/304,995

(22) PCT Filed: Jun. 13, 2008

(86) PCT No.: PCT/GB2008/050440

§ 371 (c)(1),
(2), (4) Date: Dec. 15, 2008

(87) PCT Pub. No.: WO2009/001119

PCT Pub. Date: Dec. 31, 2008

(65) Prior Publication Data

US 2010/0237966 A1 Sep. 23, 2010

(30) Foreign Application Priority Data

Jun. 28, 2007 (EP) ..... 07270034
Jun. 28, 2007 (GB) ..... 0712523.0

(51) Int. Cl.
*H01P 3/08* (2006.01)

(52) U.S. Cl. ..... 333/238; 333/246

(58) Field of Classification Search ..... 333/238, 333/246

See application file for complete search history.

(56) References Cited

U.S. PATENT DOCUMENTS

| | | | | |
|---|---|---|---|---|
| 5,481,234 | A * | 1/1996 | Landry et al. | 333/238 |
| 5,712,607 | A * | 1/1998 | Dittmer et al. | 333/238 |
| 5,724,012 | A * | 3/1998 | Teunisse | 333/238 |
| 6,414,573 | B1 * | 7/2002 | Swineford et al. | 333/238 |
| 6,535,088 | B1 * | 3/2003 | Sherman et al. | 333/238 |
| 2004/0048420 | A1 | 3/2004 | Miller | |
| 2004/0174223 | A1 * | 9/2004 | Achyut | 333/1 |
| 2005/0237137 | A1 | 10/2005 | Dutta | |
| 2007/0066126 | A1 | 3/2007 | Dutta et al. | |

FOREIGN PATENT DOCUMENTS

| | | |
|---|---|---|
| EP | 1 731 006 | 12/2006 |
| JP | 2003 218611 | 7/2003 |
| JP | 2007 150526 | 6/2007 |

OTHER PUBLICATIONS

European Patent Office, International Preliminary Report on Patentability and Written Opinion, Jan. 14, 2010, from International Patent Application No. PCT/GB2008/050440, filed Jun. 13, 2008.

(Continued)

*Primary Examiner* — Benny Lee
(74) *Attorney, Agent, or Firm* — Kenyon & Kenyon, LLP

(57) ABSTRACT

A microwave circuit assembly includes a Liquid Crystalline Polymer (LCP) layer that supports at least one microwave circuit component. First and second ground plane layers form the outer surfaces of the assembly and these are spaced apart at least partially by a gas, a mixture of gases, or a vacuum, from the LCP supporting layer and the at least one microwave circuit.

11 Claims, 4 Drawing Sheets

OTHER PUBLICATIONS

Wang et al., "MIcromachining Techniques for Liquid Crystal Polymer," Jan. 21-25, 2001, Proceedings of the IEEE 14th Annual International Conference on Microelectro Mechanical Systems. MEMS 2001. Interlaken, Switzerland, IEEE International Micro Electro Mechanical Systems Conference , pp. 126-130.

U.K. Patent Office, Search Report, Oct. 22, 2007, from related UK Patent Application No. GB 0712523.0, filed Jun. 28, 2007.

European Patent Office, Search Report, Dec. 4, 2007, from related European Patent Application No. EP 07270034.7, filed Jun. 28, 2007.

* cited by examiner

MICROWAVE CIRCUIT ASSEMBLY COMPRISING A MICROWAVE COMPONENT SUSPENDED IN A GAS OR VACUUM REGION

RELATED APPLICATION INFORMATION

This application is a United States National Phase Patent Application of International Patent Application No. PCT/GB2008/050440 which was filed on Jun. 13, 2008, and claims priority to British Patent Application No. 0712523.0, filed on Jun. 28, 2007, and claims priority to European Patent Application No. 07270034.7, filed on Jun. 28, 2007, the disclosures of each of which are incorporated herein by reference.

FIELD OF THE INVENTION

The present invention relates to microwave circuit assemblies.

BACKGROUND INFORMATION

It is common practice to fabricate microwave strip line assemblies by patterning a conductor on a laminate. The pattern is capped with a second laminate in a bonded assembly. The outer surfaces of the assembly can then be clad with a conducting material to form two ground planes. Shielding vias may be used to connect the ground planes. Multi-layer circuits of this form can be produced and this type of bonded assembly is relatively easy and inexpensive to fabricate and is also robust.

A disadvantage associated with such assemblies when higher performance is required is that they exhibit relatively high microwave loss. A recently introduced alternative to these assemblies is a suspended substrate stripline (SSS) structure, where the conductor is patterned on a thin dielectric that is suspended between the two ground planes. Thus, the volume between the ground planes can mainly include air, which results in lower levels of microwave loss. A rigid silicon-based material is normally used for supporting the conductor. However, these structures are more expensive to produce than the bonded assemblies and problems can arise because silicon absorbs water and has different characteristics, e.g. dielectric constant, to the other materials that are commonly used in the circuit assembly.

SUMMARY OF THE INVENTION

According to a first aspect of the present invention there is provided a microwave circuit assembly including:

a Liquid crystalline polymer (LCP) layer supporting at least one microwave circuit component;

a first ground plane layer forming a first outer surface of the assembly and being spaced apart at least partially by a gas, a mixture of gases, or a vacuum, from the LCP supporting layer and the at least one microwave circuit component, and a second ground plane layer forming another outer surface of the assembly and being spaced apart at least partially by a gas, a mixture of gases, or a vacuum, from the LCP supporting layer and the at least one microwave circuit component.

The use of LCP layers enables production of very homogeneous layers having the same or similar temperature coefficients and with little or no fault lines.

The LCP supporting layer has an area of reduced thickness, e.g. an area that supports the microwave circuit component. The area of reduced thickness may be present on a lower and/or upper surface of the LCP supporting layer. The area of reduced thickness has a thickness of approximately 1 to 5 μm.

An inner surface of the first and/or second ground plane layer may include a recess, the recess arranged to be aligned with the at least one microwave circuit component. The ground plane layer normally includes metal material and the recess may expose the metal material.

The first ground plane layer may be connected to a first surface of the LCP supporting layer by at least one spacing layer, and the second ground plane layer may be connected to another surface of the LCP supporting layer by at least one spacing layer, wherein each of the spacing layers includes an aperture arranged to be aligned with the at least one microwave circuit component.

The spacing layers may be connected together and/or to the LCP supporting layer using bonding films. The bonding films may have a similar dielectric constant to the LCP.

At least one strengthening rib may be formed on/connected to the LCP supporting layer. The strengthening rib may be located at/adjacent an electrically benign area of the LCP supporting layer, that is to say that the ribs are, where possible, disposed away from the membrane circuit components to reduce microwave loss.

According to another aspect of the present invention there is provided a method of forming a microwave circuit assembly including:

forming at least one microwave circuit component on a supporting layer formed of a liquid crystalline polymer (LCP);

forming a first outer surface for the assembly in a form of a first ground plane layer that is spaced apart at least partially by air, a gas, a mixture of gases, or a vacuum, from the LCP supporting layer and the at least one microwave circuit component, and forming another outer surface for the assembly in a form of a second ground plane layer that is spaced apart at least partially by air from the LCP supporting layer and the at least one microwave circuit component.

The method may further include reducing a thickness of an area of the LCP supporting layer, e.g. an area that supports the at least one microwave circuit component. The thickness may be reduced by a machining process.

The method may include forming a recess on an inner surface of the first and/or second ground plane layer, the recess arranged to be aligned with a said microwave circuit component.

The at least one microwave circuit component may be formed by a deposition process, such as sputtering.

The first and/or second ground plane layer may be connected (indirectly) to the LCP supporting layer by an adhesive bonding film.

According to a further aspect of the present invention there is provided an electronic device incorporating a microwave circuit assembly substantially as described herein.

The invention described above extends to any inventive combination of the features set out above or in the following description. Although illustrative embodiments of the invention are described in detail herein with reference to the accompanying drawings, it is to be understood that the invention is not limited to those precise embodiments. As such, many modifications and variations will be apparent to practitioners skilled in this art. Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

DETAILED DESCRIPTION OF THE INVENTION

Figure 1:
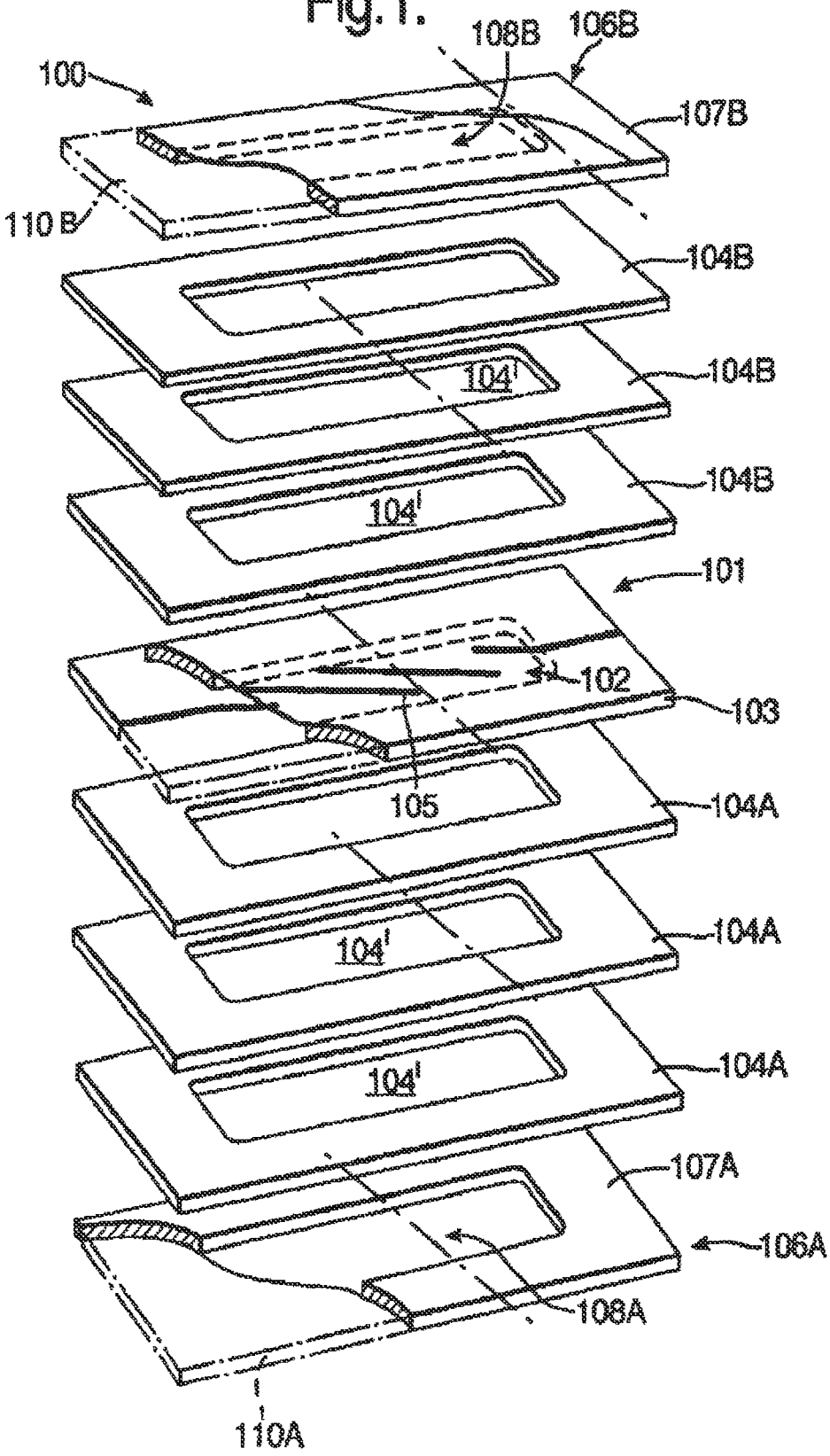
FIG. 1 is an exploded diagram of a first example of the microwave circuit assembly.

Exemplary embodiments of the present invention will now be described in more detail, by way of example only, with reference to the accompanying drawings in which identical or corresponding parts are provided with the same reference numerals in the figures.

Referring to the exploded view of FIG. 1, there is shown a circuit supporting layer 101. The layer 101 includes a rectangular piece of LCP material 103 having a thickness chosen to suit the particular application. The LCP layer 103 includes a rectangular recess 102 (around 25 mm×10 mm in area in this particular example) in its lower surface. The LCP layer 103 can either be formed including such a recess, or the recess can be formed in a flat piece of material using a plasma or laser etching process, for example. The thickness of the (remaining) LCP material in the recessed area can be in the region of about 1 to 5 μm, and provides a thin membrane for supporting circuit components, as will be described below. It will be understood that the 1 to 5 μm membrane thickness is exemplary only and in some cases may be greater or less.

A microwave circuit component 105, such as an RF pattern transmission line formed of low stress metal, can then be attached to/formed on the thin membrane region of LCP material 103. This may be done in a conventional manner, e.g. electro deposition over a sputtered seed layer.

At least one spacing layer is attached to the circuit-supporting layer 101. In the example, there is a set of three spacing layers 104A attached (directly or indirectly) in a stack-like formation to the lower surface of the LCP layer 103 and another stack of three spacing layers 104B attached to the upper surface of the LCP layer. An example of the structure of the spacing layer 104 in assembled form is shown in FIG. 2B. The number of spacing layers chosen will depend on the amount of space required between the circuit and the ground planes in the assembly. Commercially-available strips of LCP material can be used and attached together to achieve the desired thickness. Each spacing layer includes a substantially central rectangular aperture 104' that, in use, will be aligned with the thinned membrane area of the circuit-supporting layer 101. The aperture 104' can be machined into the material by a process that is suitable for the type of LCP material used.

The assembly 100 also includes lower ground plane 106A and upper ground plane 106B supporting layers. These are spaced apart from the LCP material 103 by volumes that mainly include a suitable inert gas, a mixture of inert gases, or a vacuum. A first example of the structure of a ground plane layer can be seen in FIG. 2C, which shows the upper outer layer 106B. The layer 106B includes a layer of LCP material 107B that has been machined to include a central rectangular aperture 108B. A layer of metal cladding 1108, e.g. copper having a thickness of around 1-2 μm, is attached to/formed on the upper surface of the LCP material 107B, e.g. by laser ablation to the LCP (any resulting surface roughening is normally acceptable). Therefore lower ground plane 106A includes a layer of LCP material 107A, a central rectangular aperture 108A and a layer of metal cladding 110A. In the example of FIG. 2C, the aperture 1088 exposes the lower surface of the metal cladding 1108 to the space within the assembly 100, when the components are assembled.

Figure 2A:
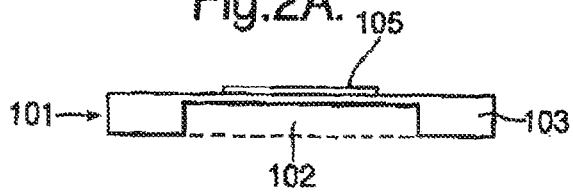
FIG. 2A is a schematic cross-sectional view through a layer of the assembly that includes a transmission line.
Figure 2B:
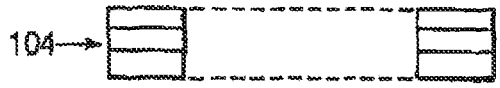
FIG. 2B is a schematic cross-sectional view through a spacing layer of the assembly.
Figure 2C:
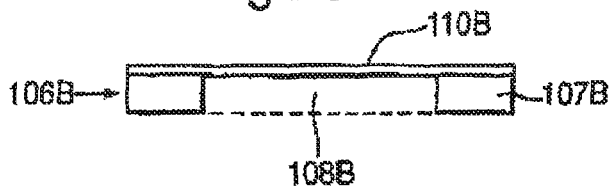
FIG. 2C is a schematic cross-sectional view through a first example of an outer layer of the assembly.
Figure 2D:
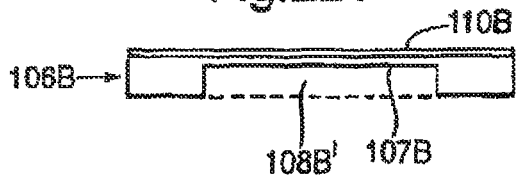
FIG. 2D is a schematic cross-sectional drawing through another example of the outer layer.

In the alternative example of the upper ground plane layer 106B shown in FIG. 2D, the LCP material has been machined to have a recess 108B' rather than an aperture, leaving a layer of around 1 to 5 μm in thickness of the LCP material 1078 beneath the lower surface of the metal cladding 1108. The reduction in thickness of the ground plane player 106B lowers the microwave losses.

Figure 3:
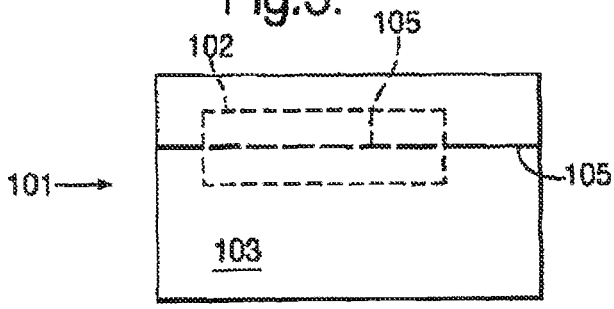
FIG. 3 is a plan view of another example of a circuit-supporting layer of the assembly.

FIG. 3 shows a plan view of another example of the circuit-supporting layer 102. As can be seen, parts of the transmission line 105 that are located within the recess 102 are exposed and "suspended", whilst other parts of the line 105' are buried within the LCP layer 103. In this example, the machining of the recess in the layer 103 is performed after the metal patterning process.

Figure 4:
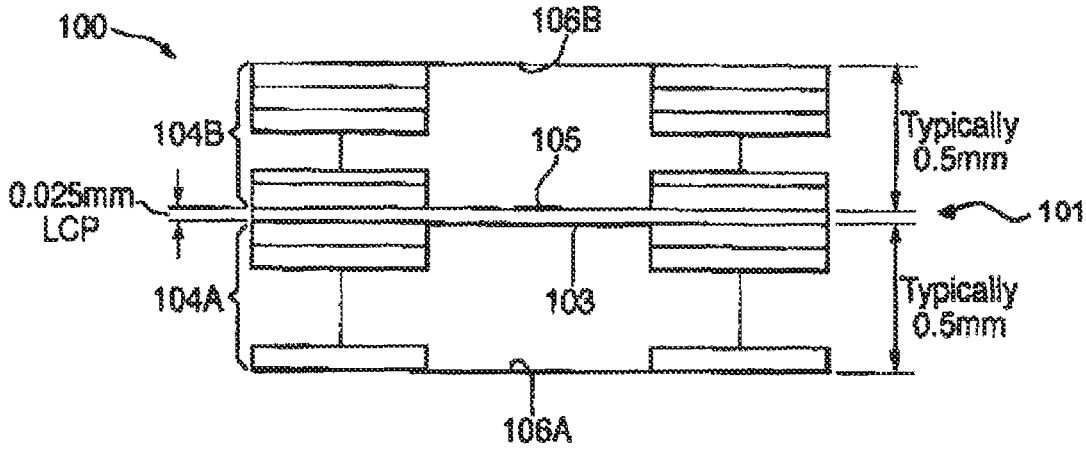
FIG. 4 is a schematic cross-sectional view through another example of the assembly.

FIG. 4 shows the various layers of another example of the circuit assembly 100 in assembled form. In this embodiment the circuit supporting layer 101 does not include a locally laser-machined thin membrane area. Instead, the entire LCP layer 103 is thin, e.g. around 0.025 mm. During assembly, the layers are 'laid up' with the layers aligned using a tool such as a dowelling jig. The ground plane supporting layers 106A and 106B are typically spaced apart from the circuit supporting layer 101 by about 0.5 mm. An even pressure is applied and the temperature of the assembly is raised to achieve the required bonding. Thus, except in the region of the membranes, the layers are fused together at the melt temperature. The layers within the stack may be alternate layers of similar layer but having slightly different melting temperatures, or they may include alternate layers of layer and bonding film. The bonding film can be the same basic material as the layers, but having a melt temperature lower than the adjacent layers. Alternatively, bonding films of a different material type can be used. It is possible to use other LCP films.

Although not shown in any of the Figures, the assembly can be completed, post-bonding, by the inclusion of electro-magnetic shielding screens. The screens can be formed by plated-through vias connecting the outer ground planes through the solid multilayer section of the assembly. Having the circuit supporting layer 101 formed of an LCP material that is the same as (or similar to) that used for the spacing layers means that the assembly process is easier and does not require a significant modification of the PCB formation process, unlike existing SSS techniques.

Figure 5:
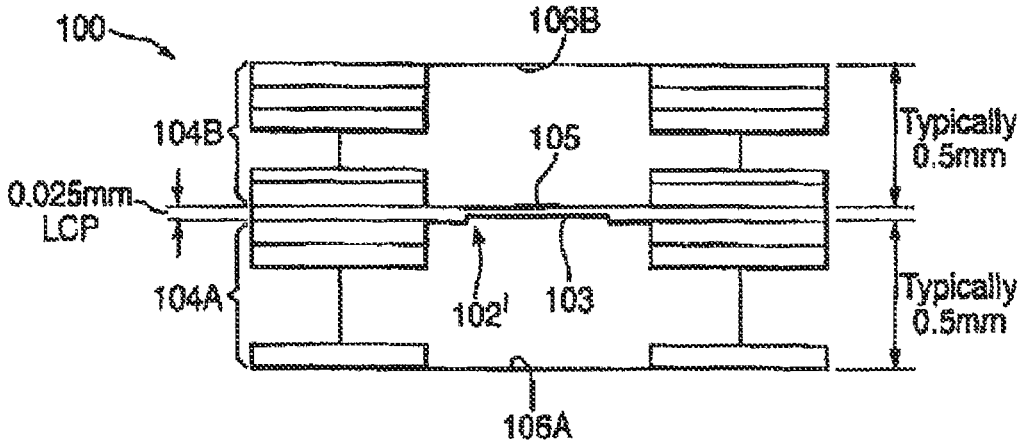
FIG. 5 is a schematic cross-sectional view through yet another example of the assembly.

FIG. 5 shows an alternative version of the assembly with further reduced thickness created by a recess 102' on the lower surface of the LCP layer 103 underneath the circuit component 105 (a cross-sectional view of this embodiment of the circuit-supporting layer 101 is shown in FIG. 2A). This further relief is designed to reduce or minimize the microwave loss contribution from the dielectric. The ground plane supporting layers 106A and 106B are typically spaced apart from the circuit supporting layer 101 by about 0.5 mm.

Figure 6A:
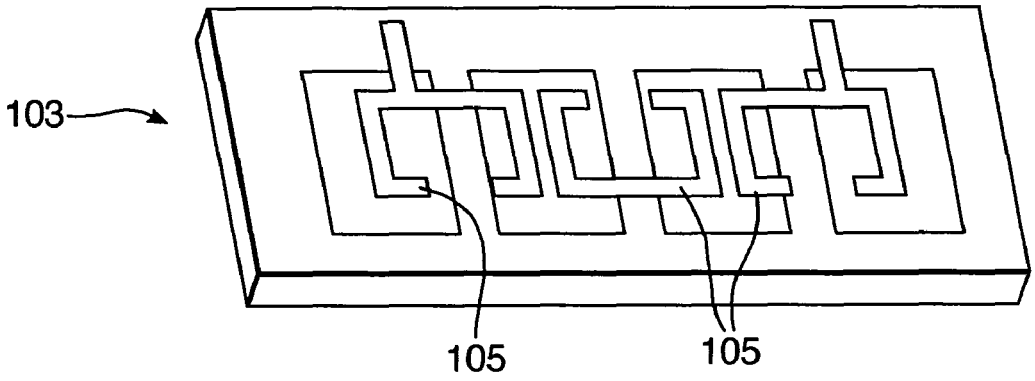
FIGS. 6(*a*) and 6(*b*) are perspective and section views through a ribbed layer.
Figure 6B:
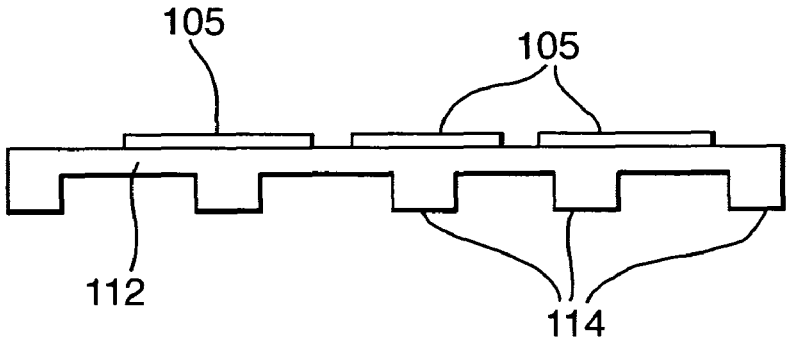

In other embodiments, recesses may be formed in both the lower and upper surfaces of the LCP layer to reduce the thickness. In some cases, ribbing may be used to strengthen thin areas of the circuit supporting layer as seen in FIGS. 6(*a*) and 6(*b*). In these Figures, the LCP supporting layer 103 (FIG. 6(*a*)) is relieved as shown to provide a thin membrane supporting layer 112 (FIG. 6(*b*)) on which the microwave circuit components 105 are formed, the membrane 112 being stiffened by the presence of ribs 114 (FIG. 6(*b*)). These ribs can be formed of LCP material and are particularly useful when larger membranes are used. The ribbing will normally be located at/adjacent regions of the membrane that are 'electrically benign', that is to say that the ribs are, where possible, disposed away from the membrane circuit components to reduce microwave loss. The ribs are spaced sufficiently to give suitable mechanical support for the membrane in its intended usage.

It will be appreciated that multilayer versions of the circuit assembly 100 can be produced and/or more than one circuit can be formed on a single thin LCP membrane. The gas spaced membrane 103 supports circuits that can be wholly surrounded by a bonded, multilayer solid dielectric circuit to provide high hermeticity protection against adverse environments. Further, the ground plane spacing between individual sections of the circuit does not have to be constant and individual circuit components can be designed using different ground plane spacings to optimize performance. The area of the polymer that supports the circuit components can closely match the footprint of the circuit and so the membrane thickness can tend to zero, with the dielectric losses also tending to zero, whereas in the case of conventional Silicon-based SSS structures, the losses tend to have some significant finite value. The relieved regions or channels may typically be about 2-3 line widths in width with the channel following the path of the microwave strip where feasible.

The invention claimed is:

1. A microwave circuit assembly, comprising:

a liquid crystalline polymer (LCP) layer supporting at least one microwave circuit component;

a first ground plane layer providing a first outer surface of the assembly and being spaced apart at least partially by a gas, a mixture of gases, or a vacuum, from the LCP layer and the at least one microwave circuit component; and a second ground plane layer providing another outer surface of the assembly and being spaced apart at least partially by a gas, a mixture of gases, or a vacuum, from the LCP layer and the at least one microwave circuit component;

wherein at least a portion of the LCP layer has a thickness of approximately 1 μm to 5 μM.

2. The microwave circuit assembly according to claim 1, further comprising:

at least one strengthening rib which is connected to the LCP layer.

3. The microwave circuit assembly according to claim 1, wherein the LCP layer includes an area of reduced thickness that supports the microwave circuit component.

4. The microwave circuit assembly according to claim 3, wherein the area of reduced thickness is on at least one of a lower surface and an upper surface of the LCP layer.

5. The microwave circuit assembly according to claim 1, wherein an inner surface of at least one of the first ground plane layer and the second ground plane layer includes one of a recess and an aperture arranged to be aligned with one of the at least one microwave circuit components.

6. The microwave circuit assembly according to claim 5, wherein the ground plane layer including one of a recess and an aperture also includes metal cladding and the at least one of the i) recess and ii) aperture exposes the metal cladding to a space within the assembly.

7. The microwave circuit assembly according to claim 1, wherein:

the first ground plane layer is connected to a first surface of the LCP layer by at least one first spacing layer, the second ground plane layer is connected to another surface of the LCP layer by at least one second spacing layer, and each of the first and second spacing layers includes an aperture configured to be aligned with one of the at least one microwave circuit components.

8. The microwave circuit assembly according to claim 7, wherein the first and second spacing layers are connected together.

9. The microwave circuit assembly according to claim 7, wherein the first and second spacing layers are connected to the LCP layer using bonding films having a similar dielectric constant to that of the LCP layer.

10. The microwave circuit assembly according to claim 1, further comprising:

at least one strengthening rib which is formed on the LCP layer.

11. A method of forming a microwave circuit assembly comprising:

forming at least one microwave circuit component supported on a layer formed of a liquid crystalline polymer (LCP), wherein at least a portion of the LCP layer has a thickness of approximately 1 to 5 μm, forming a first outer surface for the assembly in a form of a first ground plane layer that is spaced apart at least partially by a gas, a mixture of gases, or a vacuum, from the LCP layer and one of the at least one microwave circuit components, and forming another outer surface for the assembly in a form of a second ground plane layer that is spaced apart at least partially by a gas, a mixture of gases, or a vacuum, from the LCP layer and one of the at least one microwave circuit components.

* * * * *